United States Patent [19]

Login

[11] 4,118,326

[45] Oct. 3, 1978

[54] SPIN-FINISH LUBRICATING METHOD

[75] Inventor: Robert B. Login, Woodhaven, Mich.

[73] Assignee: BASF Wyandotte Corporation, Wyandotte, Mich.

[21] Appl. No.: 656,460

[22] Filed: Feb. 9, 1976

Related U.S. Application Data

[63] Continuation-in-part of Ser. No. 521,691, Nov. 7, 1974, abandoned.

[51] Int. Cl.[2] ..... D06M 13/30; D06M 5/10; D06M 13/00

[52] U.S. Cl. ..... 252/8.6; 8/115.6; 8/169; 8/176; 252/8.9; 252/356; 260/584 B; 260/611.5; 260/613 B; 427/172; 427/176; 427/390 R; 427/394

[58] Field of Search ..... 8/169, 176, 115.6; 427/172, 176, 390 R, 394; 260/584 B, 611.5, 613 B; 252/356, 8.6, 8.9

[56] References Cited

U.S. PATENT DOCUMENTS

| | | | |
|---|---|---|---|
| 2,828,265 | 3/1958 | Van Strica | 252/316 |
| 2,920,980 | 1/1960 | Mooberry | 427/390 X |
| 2,983,763 | 5/1961 | Krause | 260/613 |
| 2,997,407 | 8/1961 | Lawler et al. | 427/394 |
| 3,030,425 | 4/1962 | Mills et al. | 260/611.5 |
| 3,082,122 | 3/1963 | Krasny | 427/176 X |
| 3,374,275 | 3/1968 | Dickey | 260/611.5 |
| 3,377,288 | 4/1968 | Sawyer | 252/75 |
| 3,415,891 | 12/1968 | Turumara et al. | 260/611.5 |
| 3,704,225 | 11/1972 | Shay | 252/8.9 |
| 3,770,701 | 11/1973 | Lenker et al. | 252/8.9 X |
| 3,867,462 | 2/1975 | Keeney et al. | 260/611.5 |
| 3,954,631 | 5/1976 | Marshall et al. | 252/8.7 |
| 3,993,571 | 11/1976 | Marshall | 252/8.9 |

OTHER PUBLICATIONS

Chemical Abstracts, 78123w, vol. 73, 1970, p. 36.

*Primary Examiner*—Michael R. Lusignan
*Attorney, Agent, or Firm*—John W. Linkhauer; Bernhard R. Swick; Robert E. Dunn

[57] ABSTRACT

As a spin-finish lubricant for processing synthetic fibers, a nonionic polyalkoxylate surfactant of the fatty-ether alkoxylate, fatty-ester alkoxylate, or block or heteric ethylene oxide/propylene oxide type is made which contains a substantial proportion of alkali-metal or alkaline-earth metal ions and preferably anions of volatile nature, such as the anions of saturated carboxylic acids containing up to 18 carbon atoms. Such lubricants display improved stability when during a spin-finishing operation the synthetic fiber to which they have been applied is passed over a heater plate maintained at 150° to 300° Centigrade.

6 Claims, No Drawings

SPIN-FINISH LUBRICATING METHOD

CROSS-REFERENCE TO RELATED APPLICATION

This application is a continuation-in-part of my earlier filed application, Ser. No. 521,691, filed Nov. 7, 1974, now abandoned.

BACKGROUND OF THE INVENTION

1. Field of the Invention

This invention relates to the spin finishing of synthetic fibers in which such fibers are passed over a heater plate maintained at 150° to 300° Centigrade, and in particular to a process wherein a stabilized nonionic surfactant material is applied to the fiber as a lubricant before the fiber is passed over such heater plate.

2. Description of the Prior Art

Many polyalkoxylate nonionic surfactants are known. They are made by starting with a material having one or more active hydrogen atoms such as an alcohol, phenol or amine, and then reacting it with several moles of at least one lower alkylene oxide, such as ethylene oxide or propylene oxide. Ethylene oxide units confer hydrophilic properties and propylene oxide units confer hydrophobic properties. Those skilled in the art can often readily determine how to make a nonionic surfactant of desired properties, taking into account the relevant factors (starting material, desired physical form, desired hydrophilic-hydrophobic balance, etc.). Many of the known compositions of this kind are liquids, rather than being gels, pastes, or solids (flakes or powders), and it is with the liquids that this invention is principally concerned.

In making liquid surfactants of this kind, it has been usual to use for the polyalkoxylation reaction a catalyst such as sodium hydroxide, potassium hydroxide, sodium ethylate, sodium methylate, potassium acetate, sodium acetate, or trimethylamine. It takes very little of the catalyst to get the desired effect. In most instances, 0.1 weight percent of potassium hydroxide will suffice.

After the polyalkoxylation reaction, it has been common, in making these liquid nonionic surfactants, to do one or the other of two things: (1) and acid to neutralize the catalyst, acetic acid or phosphoric acid being often used, or (2) mix the product with a very finely divided activated silicate material and then filter, to remove substantially all ionic materials from the product. Alternative (1) is usually adopted only when the product is too viscous to be filtered, a solid at room temperature, or the amount of catalyst used has been kept quite low. More often, alternative (2) is used. In either event, the liquid nonionic polyalkoxylate surfactant compositions made prior to this invention have had very little alkali-ion content or none at all. Moreover, it has not been suggested that there would ever be any reason to use more potassium hydroxide or the like than the minimum necessary to catalyze the reaction, or to take measures to obtain a final product containing any appreciable content of metal ions.

It has also been observed that the liquid surfactant materials made according to practices outlined above are not particularly stable when exposed to air at temperatures such as 190° to 250° Centigrade. In cup tests (2 grams, exposed in a glass dish or aluminum cup to air for 1 hour at 220° Centigrade, with weight taken before and after), many such liquid surfactant materials leave a residue of only 0.5 to 3 weight percent, and though some others appear to have greater stability under such conditions (showing residue values such as 40 or 65%), they are nevertheless capable of being improved. Under conditions even more stringent (1 hour at 250° C.), the untreated materials with which I have worked never left a residue of more than 30%, and most of them did not leave as much as 2% residue. Even under mild conditions (1 hour at 190° C.), only two materials out of eleven gave residue values as great as 60%.

It is also worthy of mention that polyalkoxylate nonionic surfactants of the paste or flake type, i.e., ones that are not liquid at room temperature, are not usually filtered, and they therefore naturally contain alkali-metal ions to at least the extent resulting from the use as a catalyst of an alkali-metal compound.

In recent years, there has been increasing use of manmade fibers such as polyesters and polyamides, particularly ever since it has become known how such fibers may be texturized by being subjected to a false-twist process. In the texturizing process, the fiber is passed over a heating plate which is maintained at a temperature on the order of 150° to 300° Centigrade. In the handling of fiber, it is usually desirable to have on the surface of the fiber a small proportion of a lubricant material, to make the fiber less prone to static, snarls and breakage. For ordinary purposes—for example, when no heating step is involved—it is possible to use a suitable liquid polyalkoxylate nonionic surfactant as such a lubricant. As explained above, most of such surfactants have a considerable tendency to become volatilized and lost if subjected to any temperature such as 150° to 300° Centigrade. Those skilled in the art have used such materials, but they have endured the attendant drawbacks, which include the generation of smoke at the heating plate and the substantial absence of or ineffectiveness of the lubricant with respect to the fiber in the portion of the texturizing equipment downstream of the heating plate.

Accepting the above-indicated drawbacks, those skilled in the art of texturizing manmade fibers by spin finishing have used various polyalkoxylate nonionic surfactants which are commercially available, both the totally deionized ones and the ones from which the alkaline catalyst has not been removed. The ones of the latter kind contain, as indicated above, about 0.1 weight percent of, for example, potassium hydroxide, or somewhat less. Viewed in retrospect in the light of the knowledge of the present invention, the results when the ones not deionized were used appear to be slightly better than the results obtained when completely deionized surfactants are used. It is to be understood, however, that the results obtained with the ion-containing commercially available nonionic surfactants of the prior art are substantially distinguishable from the better results obtained in accordance with the present invention, in which surfactant compositions are provided which contain an effectively oxidation-reducing and stability-promoting amount of a suitable alkali-metal salt or the like, i.e., compositions which ordinarily contain at least twice as great a proportion and more usually something like 10 to 30 times as great a proportion of ions of alkali metal or the like.

SUMMARY OF THE INVENTION

As part of the texturizing or bulking process manmade fibers are passed over a heating plate maintained at 150° to 300° Centigrade, and a small proportion of polyalkoxylate nonionic surfactant is applied to the fiber before it passes over the heating plate; in such a process, the invention comprises using a surfactant composition which contains a relatively great proportion, such as 0.2 to 2.0 weight percent (expressed as KOH) of alkali-metal acetate or its equivalent, thereby obtaining the benefits of a composition with greatly improved high-temperature stability and oxidation-resistance, so that an effectively lubricating amount of the composition survives the heating operation.

DESCRIPTION OF THE PREFERRED EMBODIMENTS

In accordance with the invention, a liquid polyalkoxylate material, such as a nonionic surfactant material is made, substantially in accordance with practices hitherto known and used, except for the differences particularly pointed out below. The differences relate to measures taken in order that the product may contain a proportion of metal ions that will be effective to promote the stability of the composition when it is exposed to air at temperatures such as 150° to 300° Centigrade, more usually 190° to 250° Centigrade. The proportion of alkali-metal ions effective for such purpose is commonly on the order of the equivalent of 0.2 to 2.0 weight percent of potassium as KOH. The composition preferably also does not contain anions such as phosphate which are poor bases and non-volatile as the conjugate acid, but rather contains anions of lower saturated carboxylic acids, such as acetic acid. Moreover, salts of other suitably volatile acids may be used, such as the following, it being understood that the following enumeration is to be taken as exemplary and not in a limiting sense, namely: formic, propionic, thioacetic, chloroacetic, dichloroacetic, bromoisobutyric, methoxyacetic, ethoxyacetic, butyric, valeric, caproic, oxalic, malonic, succinic, chlorosuccinic, glutaric, benzoic, toluic and lactic acids. Those skilled in the art will readily appreciate that salts of many other acids of similar chemical structure and characteristics may likewise be used.

In one manner of practicing the invention, there is used a proportion of alkali-metal hydroxide as catalyst for the polyalkoxylation reaction that is distinctly greater than usual. While it has been common to use as little of such catalyst as will accelerate the reaction satisfactorily, such as about 0.1 weight percent KOH or less, I find that for the purposes of this invention it is desirable to use at least 0.2 weight percent of KOH and, depending upon the circumstances, possibly as much as 2 or 3 weight percent of KOH. Moreover, the often-practiced step of filtering in admixture with finely divided activated silicates to remove all ionic materials is eliminated, and to the extent that a neutralization of the material is desired or necessary, I preferably add an acid having anions which as the conjugate acid are relatively volatile at temperatures such as 190° to 250° Centigrade, such as acetic acid, or if desired, a different saturated carboxylic acid having up to about 18 carbon atoms. In this way, I may produce a liquid composition consisting principally of nonionic polyalkoxylate surfactant matter and containing a proportion of alkali-metal ions effective to promote the stability of the composition when exposed to air at a temperature between 190° Centigrade and 250° Centigrade.

In another manner of practicing the invention, a nonionic polyalkoxylate surfactant material is prepared exactly according to prior-art practices, including the filtration to remove ionic materials, but there is then added to the material an adequate quantity of a substance furnishing the desired proportion of metal ions. Commonly, this may be sodium acetate or potassium acetate, added to an extent such as 0.2 to 2 weight percent. It is usually desirable that the salt be added in the form of an aqueous solution. For most purposes, it is usually not necessary to take measures to remove the water added along with the salt.

Still another possible manner of practicing the invention is to use the alkali-metal acetate as catalyst for the polyalkoxylation reaction, and in so doing, to use more of it than is necessary or usual, such as 0.2 to 2.0 weight percent instead of the usual 0.05 to 0.15 weight percent, so that there will be obtained a product adequately provided with alkali-metal ions.

While not wishing to be bound by any particular theory, I theorize that in the matter of promoting the thermal stability of various polyalkoxy compositions, I have discovered that it is important that there be provided in the composition a quantity of metal ions, often but not necessarily ions of alkali metals, capable of tying up any carboxylic acid groups developing by autoxidation in the polyalkoxy composition when it is exposed to air at a service temperature such as 190° to 250° Centigrade, thereby preventing unwanted evolution of carbon dioxide and consequent degradation of the polymer, which would otherwise occur in the presence of carboxylic acid groups. In a preferable manner of practicing the invention, the metal ions are supplied in the form of salts of relatively volatile acids, such as acetic acid or other material that will volatilize when, acting as a base, it neutralizes the above-mentioned carboxylic acid groups and simultaneously forms the conjugate, volatile acid. This is contrary to the teachings of the prior art, in accordance with which the amount of potassium hydroxide used to prepare the oxide polymer would be kept as small as possible. Tests have revealed that although some material made in a laboratory on a small scale, wherein the usual filtration with the use of activated silicate was not practiced, would yield a material of adequate stability, material made in accordance with the usual commercial practices, using the activated silicates, did not have the desired stability. It has thus been appreciated, in making of liquid polyalkoxylate nonionic surfactant compositions, that impurities of alkali-metal ions, such as sodium or preferably, potassium, of the kind that result from the use of sodium or potassium compounds as catalysts for the reaction of epoxyalkane with the starting amine or alcohol, have an important influence upon the stability of the final nonionic surfactant material obtained. This has never heretofore been appreciated. As mentioned above, it has been usual to use as little of potassium hydroxide or sodium hydroxide as possible, to obtain the necessary catalytic effect, and then to remove or neutralize said hydroxide. In accordance with the invention, however, there are thus obtained nonionic surfactant materials resulting from the reaction of amines or alcohols with epoxyalkanes that contain, in effect, desirably larger portions of sodium ions or potassium ions, and preferably, a sufficient number of same to be effective to neutralize any carboxylate groups present in the materials formed by the vigorous oxidative conditions encountered in service at temperatures such as 190° to 250° Centigrade, for example, during fiber processing at such temperatures. Although substantial benefits may in many instances be obtained with the use of relatively smaller proportions of material providing suitable potassium ions or the like, it is preferable, in accordance with the present invention, to provide on the order of 80 to 105 percent as many metal ions as are required in order to achieve, during a subsequent exposure of the nonionic surfactant composition to a service temperature on the order of 220° Centigrade, sufficient of said ions to tie up any carboxylate groups present due to autoxidation.

The improvement may be obtained with any polyalkoxylate nonionic surfactant composition. Some compositions require a substantial addition of salt before there is much improvement. With others, remarkable improvement is sometimes achieved by the addition of very little of the hydroxide or salt. In some instances, using 0.2 weight percent of KOH as catalyst and neutralizing it with acetic acid will give a material with 20 times as much residue in a high-temperature cup test as the similar but deionized material produced according to the prior art. Experimental work has been conducted in respect to particular polyalkoxylate nonionic surfactants of the kinds identified below:

| Trademark of Name | Nature | Source |
|---|---|---|
| Plurafac[1] | Polyalkoxylated straight-chain primary alcohols | BASF Wyandotte Corp., Wyandotte, Mich. |
| Pluradot[1] | Heteric-polymer alkoxylated triols | BASF Wyandotte Corp., Wyandotte, Mich. |
| Pluronic[1] | Difunctional block polymers containing EO and PO units | BASF Wyandotte Corp., Wyandotte, Mich. |
| Tetronic[1] | Polyether block polymers based on ethylene diamine | BASF Wyandotte Corp., Wyandotte, Mich. |
| Triton[2] | Polyethoxylated t-octyl-phenol | Rohm & Haas Co., Philadelphia, Pa. |
| Igepal[2] | Polyethoxylated nonyl-phenol | GAF Corp., New York |

[1]Registered trademark of BASF Wyandotte Corporation, Wyandotte, Michigan, U.S.A.
[2]Registered trademark of indicated source company.

As has been indicated above, it is considered that the active and effective entities that promote the stability of the surfactant composition are the ions of potassium, sodium or other metal present. The extent to which they are so effective is often importantly influenced by the anions present at the same time. A composition containing unneutralized KOH gives greater residues than one completely deionized, and a composition containing potassium phosphate is again superior to a deionized one, but results superior to those obtained with potassium phosphate are usually obtained with potassium acetate, a salt having an anion of a relatively volatile acid.

Polyalkoxylate materials stabilized against oxidation in accordance with the invention may be used in various ways that will be apparent to those skilled in the art. In particular, suitable stabilized polyalkoxylate materials in the nature of nonionic surfactants find use as spin-finish lubricants in the processing of textiles, or as dyeing assistants. More generally, the above-described discovery is of use in any instance in which a liquid polyalkoxylate material is exposed in service to air or oxygen at a temperature such that the material, if not adequately stabilized, will degrade, and in which the addition of a metal compound in an amount effective to provide adequate stabilization can be tolerated.

As examples of the kind of stabilization obtained in the practice of this invention, compositions were made which consisted essentially of various polyalkoxylate surfactants plus different percentages of potassium acetate. These were subjected to cup tests, involving 1-hour exposure of 2-gram samples in a circulating-air oven accurately maintained at the selected test temperature. For comparison, samples of the deionized surfactant itself were tested simultaneously. The results appear in the following Table I.

TABLE I

| Material and Temp. ° C. | | % Residue | | | |
|---|---|---|---|---|---|
| | | Deionized | 0.2% Acetate | 0.5 Acetate | 1.0% Acetate |
| A | 190 | 82.7 | 94.1 | 96.9 | 97.9 |
| | 220 | 37.9 | 76.4 | 90.0 | 92.3 |
| | 250 | 6.1 | 52.3 | 61.8 | 88.2 |
| B | 190 | 92.4 | 99.0 | 98.2 | 95.7 |
| | 220 | 65.2 | 87.5 | 92.1 | 94.3 |
| | 250 | 26.9 | 57.9 | 74.0 | 83.7 |
| C | 190 | 46.4 | 51.8 | 66.6 | 70.8 |
| | 250 | 12.8 | 21.9 | 24.1 | 27.2 |
| D | 190 | 44.0 | 51.4 | 63.0 | 62.1 |
| | 250 | 5.3 | 16.6 | 28.7 | 37.9 |
| E | 190 | 0.7 | 31.7 | 34.5 | 58.1 |
| | 250 | 0.2 | 0.5 | 0.7 | 2.6 |
| F | 190 | 32.7 | 30.0 | 61.1 | 69.8 |
| F | 250 | 0.5 | 1.2 | 13.9 | 19.0 |
| G | 190 | 1.9 | 1.2 | 8.8 | 56.8 |
| | 250 | 0.2 | 2.3 | 3.2 | 14.0 |
| H | 190 | 8.6 | 21.4 | 17.9 | 15.7 |
| | 250 | 0.7 | 5.5 | 4.4 | 5.9 |
| I | 190 | 31.2 | 55.3 | 55.6 | 59.8 |
| | 250 | 0.4 | 9.7 | 17.6 | 15.8 |
| J | 190 | 5.3 | 29.3 | 57.1 | 60.6 |
| | 250 | 0.7 | 3.4 | 21.3 | 22.4 |
| K | 190 | 56.4 | 70.6 | 71.4 | 67.9 |
| | 250 | 1.7 | 29.4 | 34.2 | 40.8 |

In Table I, the Materials A to K are identified as follows.

A—Polyoxyethylene derivative of t-octylphenol having an average of 9 to 10 EO units.

B—Polyoxyethylene derivative of nonylphenol having an average of 9 EO units.

C—Oxyethylated straight-chain primary alcohol having an average molecular weight of 770.

D—Block copolymer of polyoxypropylene and polyoxyethylene having a polyoxypropylene interior block, an average molecular weight of 4200, and about 40 weight percent of polyoxyethylene units.

E—Block copolymer of polyoxypropylene and polyoxyethylene having a polyoxypropylene interior block, an average molecular weight of the polyoxypropylene hydrophobe of 950, and about 10 weight percent of polyoxyethylene units.

F—Block copolymer similar to E but with average molecular weight of 1750 for polyoxypropylene hydrophobe and about 40 weight percent of polyoxyethylene units.

G—Block copolymer of polyoxypropylene and polyoxyethylene having a polyoxyethylene interior block, containing about 20 weight percent of polyoxyethylene units and having an average moleclar weight of 2500 for the polyoxypropylene hydrophobe.

H—Block copolymer similar to G, containing about 20 weight percent of polyoxyethylene units but having an average molecular weight of 3100 for the polyoxypropylene hyrophobe.

I—Alkoxylated triols having an average molecular weight of 3900.

J—Alkoxylated liquid triol having an average molecular weight of 4450.

K—Block polymer based upon ethylene diamine and having polyoxypropylene units interior of polyoxyethylene units, the material having an average molecular weight of the polyoxypropylene hydrophobe of about 6750 and about 40 percent of polyoxyethylene units.

The foregoing data reveal that the addition of 0.2 weight percent or more of potassium acetate fairly reliably increases the residue value, sometimes very remarkably with only a small addition (Materials A and I when tested at 250° C. and Material E when tested at 190° C. are good examples). The data reveal, moreover, that in many cases, better results are obtained with relatively greater additions of acetate, such as 1.0%.

Still other tests were conducted.

Material E, deionized, had a residue in a similar test at 220° C., of 0.5 weight percent. With 0.2 weight percent of tripotassium phosphate added, the residue value was 4.4 weight percent. With 0.2 weight percent of potassium acetate, the residue value was 33 weight percent.

Material F, deionized, tested at 220° C., gave a residue of 3.0 weight percent, but with 0.2 weight percent of tripotassium phosphate, the value was 15.0 percent, and with the same weight percentage of potassium acetate, the residue was 67 percent.

In a similar test at 220° C., Material H had, when deionized, a residue value of 1.4 percent, versus 27 percent for the same material with 0.2 weight percent potassium acetate.

In a similar test at 220° C., Material I, deionized, had a residue of 0.7 percent, but with 0.2 weight percent of potassium acetate added, the residue value was 42 percent.

Results of further tests are presented below in Table II. These were also cup tests at 220° C., 1 hour, with samples of 2 grams.

TABLE II

| Material | % Residue | | | |
|---|---|---|---|---|
| | Deionized | Unneutralized (i.e., containing about 0.2% KOH[1]) | Deionized, and 0.2% KOH added | Not deionized, treated with Acetic Acid |
| F | 2.8 | 58.5 | 14.4 | 67 |
| G | 0.5 | 59 | 20.4 | 51 |
| I | 1.0 | 56.5 | 41.0 | 49 |

TABLE II-continued

| Material | % Residue | | | |
|---|---|---|---|---|
| | Deionized | Unneutralized (i.e., containing about 0.2% KOH[1]) | Deionized, and 0.2% KOH added | Not deionized, treated with Acetic Acid |
| C | 1.1 | 33.7 | 51 | 31 |

[1]Percent reported as % KOH; actually in the unneutralized sample, the potassium is bound as an alkoxide.

Additional tests were conducted with Material C. Approximately 20 grams thereof were divided into five portions of approximately 4 grams each. Potassium hydroxide (20 weight percent aqueous solution) was then added to four of the five portions, in amounts such as to give compositions containing 0.2, 0.6, 1.2 and 2.0 weight percent of KOH. One portion was left untreated, as a control. All the portions were given an initial drying, by being heated at 110° C. in a forced-air oven for 30 minutes. The portions were then placed into glass dishes and tested by exposure at 220° C. in a forced-air oven for 1 hour. The results were as indicated in Table III below. In each case, the residue was water-soluble.

TABLE III

| % KOH Added | pH | % Residue |
|---|---|---|
| 0 | 4.2 | 23 |
| 0.2 | 4.4 | 67.6 |
| 0.6 | 4.9 | 80.6 |
| 1.2 | 7.6 | 92.1 |
| 2.0 | 10.6 | 96.4 |

Tests similar to those reported in Table III were conducted, again using Material C, but with 2-gram sample quantities, and with aluminum cups in place of glass dishes. The results appear in Table IV below.

TABLE IV

| % KOH Added | pH | % Residue |
|---|---|---|
| 0 | ND* | 2.4 |
| 0.2 | 4.4 | 50.8 |
| 0.6 | 4.8 | 72.1 |
| 1.2 | 7.7 | 96.1 |

*Not determined

Tests similar to those reported in Table IV were conducted, but with Materials D, G, and H. The results appear in Table V below.

TABLE V

| Material | % KOH Added | pH | % Residue Observed |
|---|---|---|---|
| D | 0 | ND* | 2.5 |
| D | 0.2 | 5.0 | 51.2 |
| D | 0.6 | 6.3 | 61.8 |
| D | 1.2 | 6.2 | 72.1 |
| G | 0 | ND* | 0.8 |
| G | 0.2 | 5.1 | 20.4 |
| G | 0.6 | 5.6 | 48.8 |
| G | 1.2 | 6.4 | 52.9 |
| H | 0 | ND* | 2.8 |
| H | 0.2 | 5.2 | 40.9 |
| H | 0.6 | 5.4 | 53.1 |
| H | 1.2 | 5.6 | 63.4 |

*Not determined

Additional tests were conducted, using Material F and hydroxides or salts of metals other than potassium. To be more specific, Material F was tested with calcium hydroxide, lithium hydroxide, zinc acetate, calcium acetate, magnesium acetate, aluminum acetate and sodium acetate. The above-mentioned hydroxides and aluminum acetate were added neat to Material F; the others were added in the form of an aqueous solution containing 30 weight percent of the acetate. The results appear in Table VI below. The tests were done on 2-gram samples at 220° C. for 1 hour. The reported values are averages of at least three determinations.

TABLE VI

| Substance Added | % Added | % Residue Observed |
|---|---|---|
| None | — | 1.1 |
| Lithium hydroxide | 0.2 | 12.9 |
| Lithium hydroxide | 0.5 | 20.1 |
| Lithium hydroxide | 1.0 | 21.5 |
| Zinc acetate | 0.2 | 2.8 |
| Zinc acetate | 0.5 | 4.2 |
| Zinc acetate | 1.0 | 4.9 |
| None | — | 0.9 |
| Calcium acetate | 0.2 | 14.6 |
| Calcium acetate | 0.5 | 27.2 |
| Calcium acetate | 1.0 | 40.4 |
| Sodium acetate | 0.2 | 19.5 |
| Sodium acetate | 0.5 | 30.3 |
| Sodium acetate | 1.0 | 57.4 |
| None | — | 1.1 |
| Magnesium acetate | 0.2 | 2.9 |
| Magnesium acetate | 0.5 | 4.9 |
| Magnesium acetate | 1.0 | 14.0 |
| None | — | 1.0 |
| Calcium hydroxide | 0.2 | 6.6 |
| Calcium hydroxide | 0.5 | 5.0 |
| Calcium hydroxide | 1.0 | 6.2 |
| Aluminum acetate | 0.2 | 2.5 |
| Aluminum acetate | 0.5 | 4.0 |
| Aluminum acetate | 1.0 | 6.4 |

The foregoing results demonstrate that metals other than potassium will yield effective results, and that especially favorable results can be obtained from the acetates of the alkali and alkaline-earth metals.

The foregoing results imply to those skilled in the spin finishing of manmade fibers that it is possible and advantageous to use, in place of the polyalkoxylate nonionic surfactant materials commercially available when this invention was made, modified compositions which contain alkali-metal ions in the proportions generally indicated above as yielding improved results in the tests. Manmade fibers often subjected to spin finishing include nylon and polyester (polyethylene terephthalate). The fiber may be of any suitable denier, such as apparel denier, carpet denier, or industrial denier. Denier values such as 15 to 300 are commonly encountered. In the processing of such fibers, depending upon the machinery used and the type of yarn produced, machine speeds on the order of 100 to 500 meters per minute are often used. For further details, reference is made to *Draw-Textured Yarn Technology*, published 1974 by Monsanto Textiles Company.

Those skilled in the art will understand that the surfactant may be applied to the fiber before it come into contact with the heating plate in any suitable manner, as for example by means of a kiss roll, one part of the periphery of which passes through a bath of the material to be applied and another part of the periphery of which comes into contact with the fiber. The surfactant composition may be applied to the fiber at a suitable rate, such as about one percent by weight.

Not all of the nonionic surfactant materials discussed above are equally suitable; it will be apparent from the data presented that some may be preferable to others in respect to remaining unvolatilized when subjected to the action of the heating plate, and there is the further consideration that it is desirable to use a surfactant which is biodegradable. It is usual to wash the fiber after it is texturized, and if the surfactant used is not biodegradable, additional problems arise in the disposal of the wash water. With a biodegradable surfactant, a simple digestion in a basin in which bacteria operate upon the biodegradable impurities in the water may well suffice, whereas otherwise additional treatment will be required in order to meet pollution-control standards. In particular, the alkoxylated alkylphenols are not biodegradable. Moreover, the amine-based polyalkoxylate surfactants have a tendency to become yellow when subjected to temperatures of the kind indicated above. As a consequence, it can be said that the surfactants preferred for use in accordance with the present invention are fatty-acid polyalkoxylates, fatty-alcohol polyalkoxylates, and block or heteric ethylene oxide/-propylene oxide polymers.

The structural formulae of the various preferred kinds of polymers will be discussed below. The fatty-acid polyalkoxylates are of the formula R—CO—O—-($AO_xH$, where R is an aliphatic radical containing 8 to 22 carbon atoms, and A is a bivalent radical selected from the group consisting of $—CH_2CH_2—$ and $—CH(CH_3)CH_2—$. They are made by alkoxylating a fatty acid RCOOH with ethylene oxide, propylene oxide, or mixtures thereof. The above formula is to be considered as covering both block and heteric polymers. The fatty-alcohol polyalkoxylates are of the formula $R—O—(AO)_xH$, where R and A have the significance indicated above. In either case, $x$ is an integer of such value as to afford appropriate surfactant properties, the value depending naturally upon such factors as the number of carbon atoms in R and the extent to which A is ethylene rather propylene; those skilled in the art of nonionic surfactants will appreciate how the revelant factors may be balanced to yield a material of desired hydrophobic-hydrophilic balance and desired total melecular weight; generally, $x$ has a value such as 2 to 100. The structure of the block or heteric polymers of ethylene oxide and propylene oxide is amply and accurately explained in Chapter 10, "Polyalkylene Oxide Block Copolymers", of *Nonionic Surfactants*, edited by Martin J. Schick and published by Marcel Dekker, Inc., New York, Copyright 1966.

One example of a kind of suitable nonionic surfactant polymer which is biodegradable and is useful in accordance with the present invention is a polymer such as that indicated in U.S. Pat. No. 3,770,701, except that, of course, in the preferred manner of practicing the invention, the necessary alkali-metal ions have been added, and if they have been added by use of the hydroxide, the composition has been neutralized with, for example, acetic acid. In one advantageous manner of practicing the present invention, there is used such a composition in which the molecular weight is 1000 to 2000, the potassium content (as KOH) is approximately 0.3 weight percent, and the composition is neutralized with acetic acid. The surfactants of the above-mentioned patent are of the formula R—O—(R')—(R'')H, where R is typically a mixture of straight-chain alkyl groups having 12 to 18 carbon atoms, R' is oxypropylene or mixtures of same with up to equal weight of oxyethylene, and R'' is oxyethylene or mixtures of same with oxypropylene such that oxyethylene predominates by a weight ratio of 1.3:1 to 1.8:1.

In accordance with one example of the practice of the present invention, there is prepared a composition as defined above, i.e., the alkali-metal-ion modified fatty alcohol polyalkoxylate nonionic surfactant material similar to that of the above-mentioned U.S. Pat. No. 3,770,701. A mixture of $C_{12}$ to $C_{15}$ alcohols is used, and it is alkoxylated with an equal weight mixture of ethylene oxide and propylene oxide in the presence of 0.3 weight percent of potassium hydroxide (i.e., about triple the amount ordinarily used for catalysis) and then neutralized with acetic acid. This produces a material which, if deionized, leaves about 1.2 weight percent residue in a cup test, 1 hour at 220° Centigrade, but which, containing the potassium and acetate ions, has in such a cup test a residue of approximately 50 weight percent. Such material is applied to nylon fiber at the rate of 1 percent before texturizing and gives results which are distinctly superior when the fiber is subjected to a texturizing operation in which the fiber passes over a heating plate maintained at 220° Centrigrade. The results are superior to those with a deionized surfactant or one containing only about 0.1 weight percent of KOH in that there is less volatilization and less smoke, and because a substantial portion of the material survives the heating operation, there are fewer snarls and less breakage. Moreover, the composition is biodegradable, so that disposal of wash water does not present a serious problem.

Those skilled in the art of formulating compositions for application to fibers to be texturized will appreciate that it is usual to employ a mixture of ingredients. It is common to use a mixture containing at least a lubricant, an emulsifier, and an anti-static agent, and the mixture often contains a bactericide and/or a corrosion inhibitor as well. Thus, it will be understood that in many instances the stabilized surfactant material herein taught merely comprises a principal part of the composition ultimately used, importantly affecting its ability to remain on the fiber after the heating step. For the lubricant function, the emulsifier function, and the anti-static function, slightly different ratios of ethylene oxide to propylene oxide may prove optimal, but all such compositions benefit from the stabilization effect and make possible the advance in the art herein disclosed. In the claims, the expression "consisting essentially of" is used to cover the utilization of all compositions which contain stabilized surfactants as described herein to an extent such that the indicated benefits of the present invention are obtained to a substantial extent.

While there have been shown and described herein certain embodiments of the invention, it is intended that these be covered as will any change or modification which may be made without departing from the spirit and scope of the invention.

The embodiments of the invention in which an exclusive property or privilege is claimed are defined as follows:

1. In a process of spin-finishing a synthetic textile fiber in which the fiber passes over and in contact with a heating plate maintained at a temperature of 150° to 300° Centigrade, the improvement which comprises applying to said fiber before its passage over said heating plate an amount effective to promote the handling properties of said fiber of a textile-lubricant composition, said composition consisting essentially of and effectively oxidation-reducing and stability-promoting amount up to 2 weight percent of a salt of a metal selected from the group consisting of the alkali and alkaline-earth metals with a saturated carboxylic acid containing up to 18 carbon atoms and the balance being a liquid polyalkoxylate nonionic surfactant material.

2. An improvement as defined in claim 1, characterized in that said liquid polyalkoxylate nonionic surfactant material is a biodegradable material selected from the group consisting of the fatty ether polyalkoxylates, the fatty ester polyalkoxylates, and the heteric and block polymers of ethylene oxide and propylene oxide.

3. An improvement as defined in claim 1, characterized in that said amount effective to promote the handling properties of said fiber is approximately one percent by weight of said fiber.

4. An improvement as defined in claim 1, characterized in that said effectively oxidation-reducing and stability-promoting amount of a salt is such that when said composition is exposed to air for 1 hour at 220° Centigrade, a residue of greater than 50 weight percent remains.

5. An improvement as defined in claim 1, characterized in that said liquid polyalkoxylate nonionic surfactant material is a fatty ether alkoxylate based upon a fatty alcohol containing 12 to 20 carbon atoms and oxyalkylated with an alkylene oxide selected from the group consisting of ethylene oxide, propylene oxide, and mixtures thereof to a molecular weight of 1000 to 2000.

6. An improvement as defined in claim 5, wherein said textile-lubricant composition contains the equivalent of approximately 0.3 weight percent potassium hyroxide and is neutralized with acetic acid.

* * * * *

UNITED STATES PATENT AND TRADEMARK OFFICE

CERTIFICATE OF CORRECTION

PATENT NO. : 4,118,326

DATED : October 3, 1978

INVENTOR(S) : Robert B. Login

It is certified that error appears in the above-identified patent and that said Letters Patent are hereby corrected as shown below:

Claim 1, line 8 should read:

"tion, said composition consisting essentially of an ef-"

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*